United States Patent [19]

Collazo et al.

[11] Patent Number: 4,813,678

[45] Date of Patent: Mar. 21, 1989

[54] BOARD GAME WITH DICE

[76] Inventors: Edwin Collazo, 14 Oakville St., Staten Island, N.Y. 10314; Alfredo Ramirez, 2157 Wallace Ave., Bronx, N.Y. 10462

[21] Appl. No.: 87,594

[22] Filed: Aug. 20, 1987

[51] Int. Cl.[4] ..... A63F 3/00; A63F 9/04

[52] U.S. Cl. ..... 273/243; 273/146; 273/289; 273/282

[58] Field of Search ..... 273/269, 270, 288, 243, 273/282 B, 146, 289, 256, 148 R

[56] References Cited

U.S. PATENT DOCUMENTS

| | | | |
|---|---|---|---|
| 3,976,219 | 8/1976 | Pagnoni | 273/288 |
| 4,128,246 | 12/1978 | Hicks et al. | 273/243 |
| 4,448,421 | 5/1984 | Zaruba et al. | 273/243 |

FOREIGN PATENT DOCUMENTS

| | | | |
|---|---|---|---|
| 1187095 | 4/1970 | United Kingdom | 273/146 |

*Primary Examiner*—Richard C. Pinkham
*Assistant Examiner*—Benjamin Layno
*Attorney, Agent, or Firm*—Richard L. Miller

[57] ABSTRACT

This game is designed to employ skill and chance. Primarily, it consists of a playing board with squares, and pegs in the board provide for receiving specially designed chips of different colors. A multiple number of player pieces are provided with a cylindrical body designed to pick up the chips and store them within the cylindrical body. A plunger within the cylindrical body enables the chips to be readily discharged from the player pieces. Triangular boards are also provided for each player to peg mount the collected chips to keep track of the number of chips collected during game play. Dice having directional arrows and numbers on their faces are employed as chance indicators for controlling the direction and distance the player pieces are to be moved.

4 Claims, 2 Drawing Sheets

BOARD GAME WITH DICE

BACKGROUND OF THE INVENTION

The instant invention relates generally to game boards, and more particularly, to arrow dice a game of skill and chance.

Numerous game have been provided in the prior art that are adapted to be played with skill and are also games of chance. While these units may be suitable for the particular purpose to which they address, they would not be as suitable for the purpose of the present invention as hereafter described.

SUMMARY OF THE INVENTION

A primary object of the present invention is to provide arrow dice a game of skill and chance that will overcome the shortcomings of the prior art devices.

Another object is to provide arrow dice a game of skill and chance, which will be unique and novel for competition play on a specially designed board.

An additional object is to provide arrow dice game of skill and chance, which will also employ differently designed dice and plugner player pieces for receiving unique chips.

A further object is to provide arrow dice a game of skill and chance that is simple and easy to use.

A still further object is to provide arrow dice a game of skill and chance that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DETAILED DESCRIPTION OF THE PREFERRED EMBODIMENTS

Figure 1:
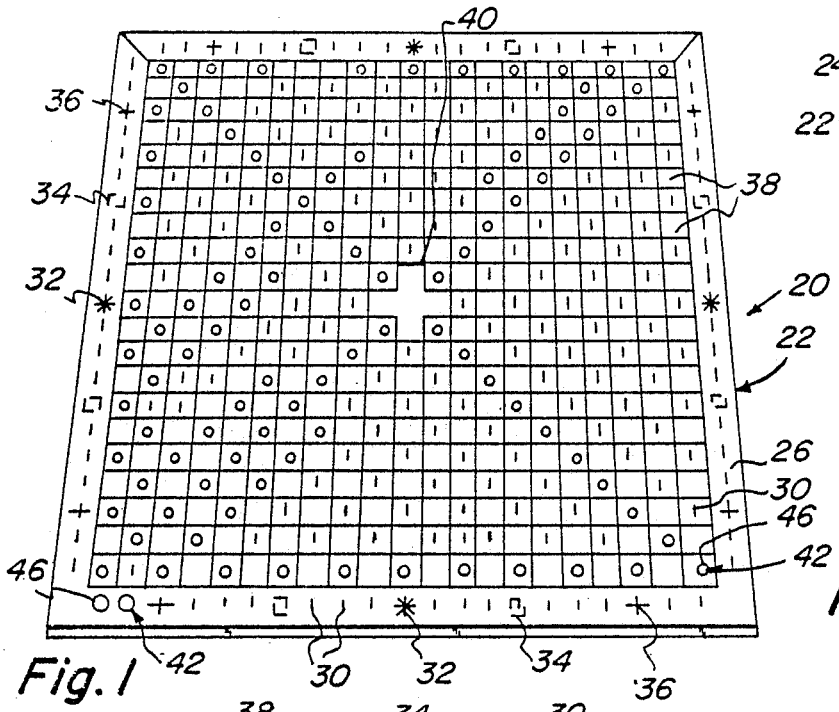
FIG. 1 is a perspective view of the game board of the instant invention, showing some of the playing pieces thereon.
Figure 2:
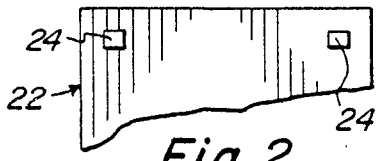
FIG. 2 is a fragmentary bottom plan view of the board shown in a smaller scale.
Figure 4:
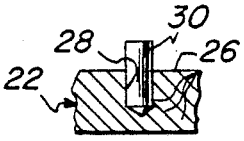
FIG. 4 is a cross sectional view taken along the line 4—4 of FIG. 3.
Figure 5:
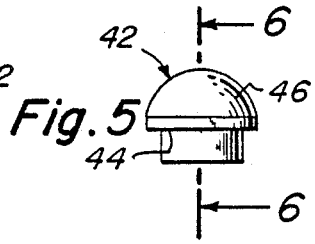
FIG. 5 is an enlarged vertical elevational view of one of the playing pieces of the game.
Figure 3:
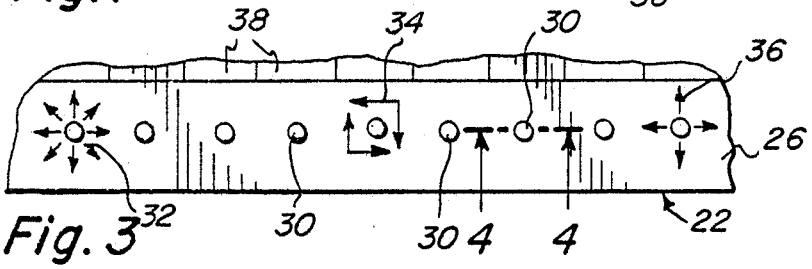
FIG. 3 is an enlarged fragmentary plan view of a portion of the game board.
Figure 6:
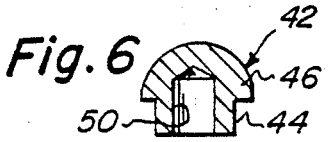
FIG. 6 is a cross sectional view taken along the line 6—6 of FIG. 5.
Figure 7:
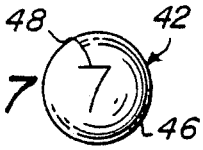
FIG. 7 is a top plan view of a typical playing piece shown in FIG. 5.
Figure 10:
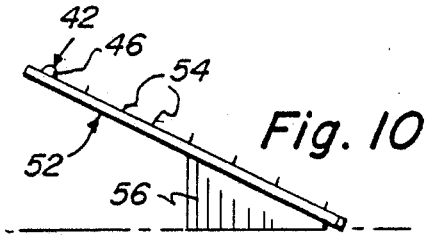
FIG. 10 is a side view of triangular board of figure 9, shown on a smaller scale and illustrating one playing piece thereon.
Figure 8:
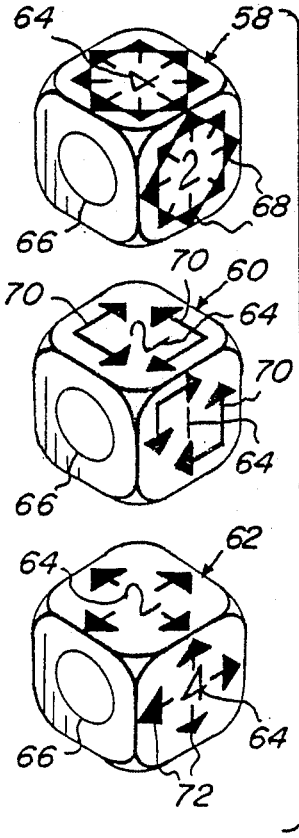
FIG. 8 is a view of the different dice employed in playing the game.
Figure 9:
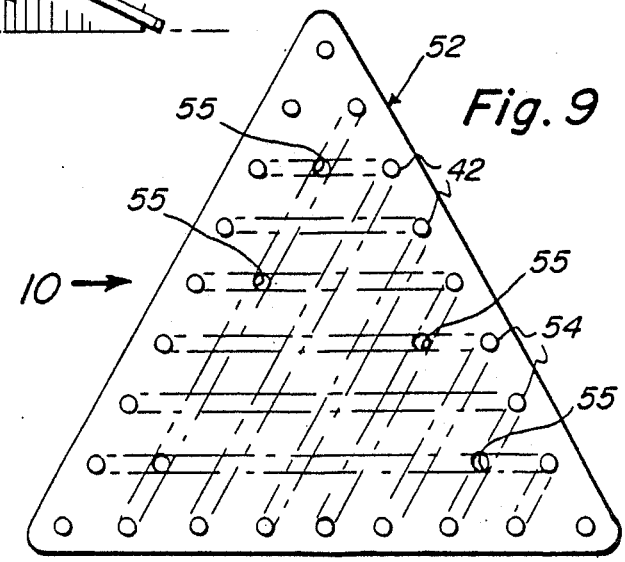
FIG. 9 is a top plae view of one of the triangular boards employed in playing the game.

Turning now descriptively to the drawings, in which like reference characters denote like elements throughout the several views, a game 20 is shown to include a playing board 22 having a foot 24 in each corner of the bottom side, for elevating board 22 upon a table. An outside border 26 is provided on the top surface of board 22 and includes equally spaced openings 28 having pegs 30 fixedly secured therein, for a purpose which hereinafter will be described. On each side of border 26 around some of the pegs 30, are inscribed eight arrow symbols 32, two arrow symbols 34, and four arrow symbols 36, and a plurality of squares 38 are inscribed within the confines of border 26. A cross 40 is inscribed in the center of board 22 and other pegs 30 are secured fixedly within openings 28 provided in alternate squares 38, for freely receiving chips 42 that are playing pieces. The chips 42 are two-hundred and twenty in number and groups thereof, are red, mint green, lavender, purple, pink, green, orange, blue, gray and yellow, for identification, and it shall be noted, that the various portions of board 22 may be of any desired colors.

The structure of each chip 42 includes a cylindrical base 44 integrally attached to a domed portion 46, and a numerical character 48 is inscribed on top of the domed portion 46. An opening 50 is also provided in the bottom of each chip 42, enabling chip 42 to be freely received on a peg 30.

Four boards 52 are provided and are triangular in shape and are provided with a plurality of pegs 54 in openings 55 that are equally spaced apart for receiving chips 42, and the object of game 20 is for a playr to fill his board 52 with the required number of colored chips 42, as was heretofore described. A pedestal 56 is fixedly secured to the bottom of each triangular board 52 for elevating board 52 at the angle.

Figure 12:
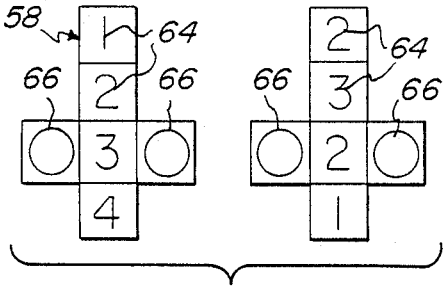
FIG. 12 is a diagrammatic layout of dice faces.
Figure 14:
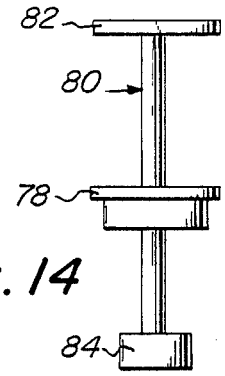
FIG. 14 is a vertical view of the plunger and cap, show in elevation and removed from the cylinder of FIG. 13.

Five dice 58, 60, and 62 are provied for playing game 20, and each are inscribed with numerical characters 64 numbering from one to four. A pair of blank circles 66 are provided on opposite faces of each die, for giving a zero random reading sometimes, and encircling numerical characters 64 on die 58, are radially spaced arrows 68 which are eight in number. Encircling characters 64 on die 60, are a pair of arrows 70, and encircling characters 64 on die 62, are four arrows 72, the layout of dice 58, 60, and 62, being illustrated in FIG. 12 of the drawings. Of the fives dice there are two pair of the 70 and 72 arrow type.

Referring now to FIGS. 13 through 16, a player piece 74 is provided and includes a hollow clear plastic cylinder 76 for receiving a plurality of chips 42. Player pieces 74 are twenty in number, five being employed by each player, and a cap 78 is frictionally received in the upper end of cylinder 76. A plunger 80 is freely received through cap 78 and a top head 82 is fixedly secured to one end of plunger 80, for forcing plunger 80 downward to discharge chips 42 therefrom. A bottom head 84 is also fixedly secured to the other end of plunger 80, for engagement with chips 42, and the top heads 82 of plungers 80 are inscribed with the arrow symbols 32, 34 and 36 to correspond with the same described symbols inscribed on board 22.

A soft rubber disc 86 is fixedly secured to the bottom end of cylinder 76 and is provided with a central opening 88 for frictionally engaging with the outer periphery of the chips 42, so as to pick chips 42 up from board 22, and the opening 88 through disc 86, is smaller in diameter than the bore 90 of cylinder 76, so as to provide the shoulder 92 for retaining chips 42 within the bore 90 after being picked up.

Figure 13:
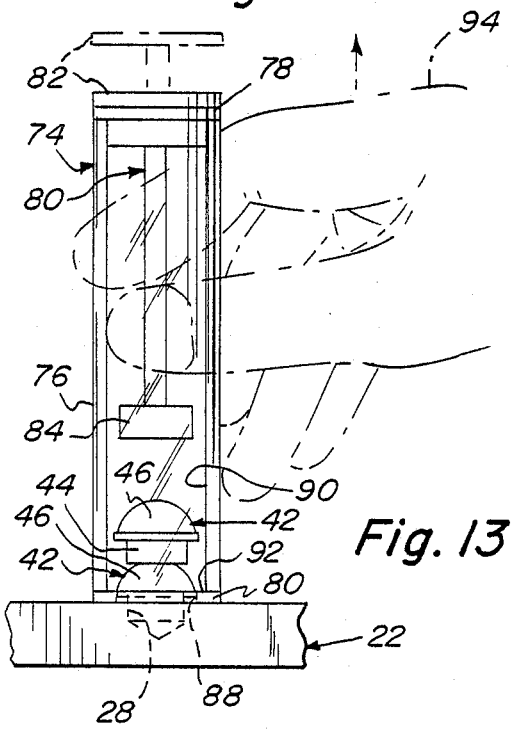
FIG. 13 is a vertical view of one the piece pickup cylinders of the gam showing a player's hand and the plunger partly elevated in phantom and illustrates the pickup and storage of playing pieces.
Figure 16:
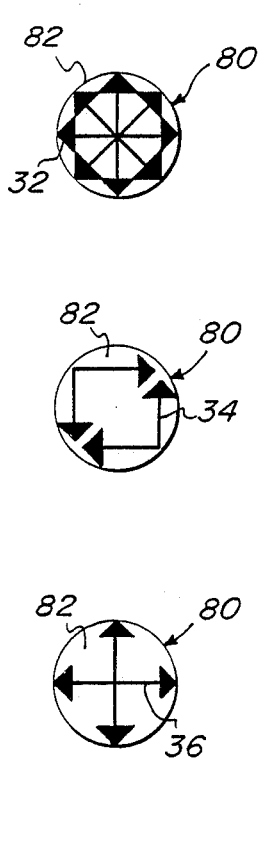
FIG. 16 is a top plan view of three of the differently marked cylinder and plungers combinations employed in the game.
Figure 15:
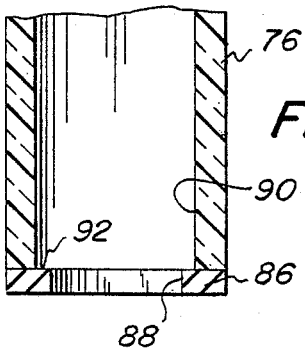
FIG. 15 is an enlarged sectional elevational fragmentary view of the cylinder of FIG. 13.
Figure 11:
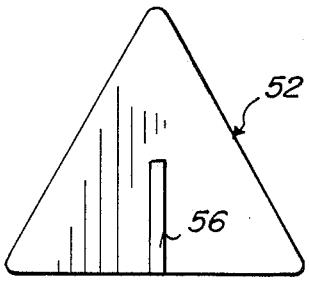
FIG. 11 is a bottom plan view of one of the triangular boards of FIG. 9.

In operation, cylinder 76 is grasped in the hand 94 of a player, as illustrated in FIG. 13. The player than aligns the bottom of cylinder 76 with a chip 42 in opening 28 of board 22 and urges downward.

The chip 42 is forced into the opening 88 frictionally and the player then lifts upward and the chip remains in the rubber disc 86. When another chip 42 is to be picked up, the cylinder 76 is again aligned with the mounted chip 42 and downward pressure is again applied, which causes the base 44 of the retained chip 42 to engage with the domed portion 46 of the chip 42 being picked up. The above mentioned, forces the upper chip 42 into the bore 90 of cylinder 76 and the bottom chip 42 is frictionally retained in the opening 88 of disc.

When it is desired to remove the chips 42 from within the bore 90, the player urges downward on the head 82, which forces the chips 42 outward of cylinder 76.

INSTRUCTIONS

The object of the game 20 is to be the first player to fill his triangular board 52 as follows:

The red colored chip 42 with the inscribed numerical character one, is placed on the topmost peg 54, and succeeding down the board 52, two mint green chips 42 with characters two, are placed on the next two pegs 54. The three lavender colored chips 42 with the character three thereon, are placed on the next three pegs 54, and the four purple colored chips 42 with the character 4 thereon, are placed on the next four pegs 54. The five pink colored chips 42 with the character 5 thereon, are placed on the next five pegs 54, and the six green colored chips 42 with the character six thereon, are placed on the next six pegs 54. The seven orange colored chips 42 with the character seven thereon, are placedon the next pegs 54, and the eight blue colored chips 42 with the character eight thereon, are placed on the eight pegs 54. On the bottom row, the nine yellow colored chips 42 with the character nine thereon, are placed on the bottom nine pegs 54.

RELATION OF THE DICE TO THE PLAYER PIECES (a) One eight arrow die 58 is provided for one eight arrow inscribed player piece 74.

(b) Two two arrow inscribed disc 60 are provided for two (two) arrow player pieces 74.

(c) Two four arrow dice 62 are provided for two (four) arrow player pieces 74.

ROLLING OF THE DICE

A player rolling a blank face on a die, forfeits the move for one of its matching player pieces 74.

In the event a player rolls a number on all five of the dice, the player receives one more roll of the dice and the player's turn of play ends.

A player rolling a number on all five dice on his second roll, does not roll again.

A player rolling five blank faces on the dice, receives one more roll only.

MOVEMENT OF PLAYER PIECES

The two player pieces 74 move the same amount of spaces vertically then horizontally, or horizontally then vertically.

The eight arrow player piece 74 moves in any one of eight directions on each roll of the dice.

A four arrow player piece 74 moves in any one of four directions per roll of the dice.

A two arrow player piece 74 moves at a right angle. For example, when a two arrow die 60 is rolled and the face up number is a three, the player piece 74 is then moved three spaces horizontally and three spaces vertically.

PRIOR TO STARTING THE GAME (a) Each player selects a set of five player pieces 74, one triangular board 52, and one side of the game board, the above all being the same in color.

(b) The players then place all of chips 42 on their color matching pegs 30 on the playing board 22.

(c) Each player places his five player pieces 74 on his side of the playing board 22 in such a manner, that the arrows on his player pieces 74 match the arrows on the spaces in the starting position.

(d) Each player places his triangular board 52 to the side of the playing board 22.

(e) Each player takes a turn of the dice and the player rolling the highest number player first. The play always moves to the left.

NUMBER OF SPACES MOVED BY A PLAYER PIECE

The number of spaces moved by a player piece 74 is determined by the number rolled on its matching die.

For example, after the roll of dice a player gets an eight arrow die 58 with the three up, the eight arrow player piece 74 may move three spaces.

if a four arrow die 58 has a two face up and the other has a three face up, the player has a choice of moving either of the four arrow player pieces 74 two spaces and the other three.

If a two arrow die 60 has a three face up, and the other has a one face up, the player has the choice of moving either the two arrow player pieces three spaces and the other, one.

ENTERING OF PLAYER PIECES ONTO THE PLAYING BOARD (a) Entering a two arrow player piece 74 onto the playing board from its starting position, the player must first move in a vertical direction and then complete the move according to the rules.

(b) Entering a four arrow player piece 74, the player must move it in a vertical direction.

(c) Entering an eight arrow player piece 74, a player has a choice of entering it vertically or diagonally.

A player may not at anytime move over any other player piece 74.

A player may not move his player piece 74 on or over the shaded area in the center of the playing boarding 22.

On a roll of the dice a player must at all times move whatever pieces 74 are in his starting position, onto the playing board 22, whenever possible.

A player may not move the same piece 74 twice on one roll of the dice.

For example, a player may not use the combined numbers of two dice to move one piece 74.

A forfeited move:

In the event a player is unable to enter his piece 74 onto the playing board 22 from his starting position or move a piece 74 already on the playing board, due to other pieces 74 resting in the player path, the player must forfeit that move.

COLLECTING CHIPS

1. A player collects chips 42 as he moves his player pieces along its path.
2. A piece 74 that has collected a chip 42, must remain on the playing board 22 at the end of its moves.
3. If at the end of a move the cap 78 on the player piece 74 is raised, it indicates the piece must come off the playing board 22 and the player must then empty his piece and place it back on its starting position.
4. If a player moving a player piece 74 with a chip 42 in it from a previous move is unable to pick up another chip 42, the player must empty the piece and place it back on starting position.
5. At the end of a player's turn he then places the collected chips 42 on his triangular board 52. The color of the chips must match the color of the pegs 54 on the board 52.
6. Gray chips 42 collected, are placed on white pegs of player's starting.
7. Extra numbered chips 42 are also placed on white pegs of player's starting position. An extra numbered chip is a chip that is not needed by a player.
8. Moving an empty piece:

Providing that there are no chips 42 in player's path, a player may move an empty piece as often as he likes, without having to pick up a chip. However, once the piece has collected a chip, it must pick up another chip the next time the piece is moved, or the player is forced to empty the cylinder and place it on its starting position.

CAPTURING AN OPPONENTS PIECE

1. If a piece 42 comes to rest by exact count on a space occupied by an opponent's piece, the player has captured the opponent's piece.
2. When a player captures an opponent's piece, he then keeps the opponent's chips that are in his piece, and plces them on his triangular board 52. The player then returns the empty player piece back to his opponent to place on his starting position.
3. A player may not capture an opponent's piece when the opponent's piece is empty.

RETURNING PIECES TO STARTING POSITION

Any player returning a piece to the starting position, has the option of placing a two or four arrow piece at either end of his starting position, providing that the space is not occupied and the arrows on the pieces match arrows on the spaces.

BUYING A CHIP FROM AN OPPONENT

1. A player must wait his turn.
2. A player must buy before the rolling of the dice.
3. A player must have the number of gray chips 42 needed according to the value of the chip he is buying.
4. a player may only buy one chip per turn.

| CHIP NUMBER | | CHIP VALUE IN GRAY CHIPS |
|---|---|---|
| #1 | → | 6 |
| #2 | → | 5 |
| #3 | → | 5 |
| #4 | → | 4 |
| #5 | → | 4 |
| #6 | → | 4 |
| #7 | → | 5 |
| #8 | → | 5 |
| #9 | → | 6 |

A player needing one chip to win the game, may not buy it from an opponent unless it is not available on the playing board.

A player having the necessary chips needed to win the game in his player piece, may only remove it from the playing board according to the rules under (Collecting chips).

Once a player picks up the chip with his player piece, he may not avoid picking up another chip on a piece's next move.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. An arrow dice game, comprising, a game board, a plurality of triangular boards, for tallying score of said game, a plurality of plunger player pieces having heads received in said plunger player pieces, for playing said game and picking up and storing a plurality of chips, and a plurality of different arrow symboled dice, providing a selection of moves to be made, wherein said game board is provided with a border having a plurality of pegs and some of said pegs extend upward through a same said plurality of different arrow symbols inscribed on said border, and a similar same said plurality of different arrow symbols are provided on the heads of plungers received in said plunger player pieces, wherein for every die having a particular arrow symbol there is a least one plunger head having said same particular arrow symbol, and each said same particular arrow symbol is inscribed at least once on said border of said game board whereby values indicated on a particular arrow symbol die may be associated with the moves to be made with a plunger player piece having the same particular arrow symbol.

2. A arrow dice game as set forth in claim 1, wherein said chips are removable from said game board by means of said plunger player pieces, and said chips each include a cylindrical base with an opening for receiving one of said pegs, and a domed portion is integrally attached to said base and is inscribed with a numerical character, and said domed portion provides for easy alignment and engagement with an opening through a rubber disc that is fixedly secured to one end of a transparent cylinder comprising the main body of said plunger player pieces.

3. An arrow dice game as set forth in claim 2, wherein said cylinder when grasped by a player and pushed downward on a peg mounted chip, causes entry of said domed portion into the opening of said disc and a said disc frictionally retains said chip for removal from said game board and also provides vertical stability for holding said plunger player piece upright on said game board.

4. An arrow dice game as set forth in claim 3, wherein the opening through said disc is smaller in diameter than the bore of said cylinder, resulting in an annular shoulder on said disc that will engage with the underside of said domed portion of said chip and retain said chip and all other said chips within said cylinder, and a cap is removably received in said cylinder and freely receives a plunger that is urged downward by a user to discharge said chips from within said cylinder.

* * * * *